US010654052B2

(12) United States Patent
Fujiwara et al.

(10) Patent No.: US 10,654,052 B2
(45) Date of Patent: May 19, 2020

(54) DISCHARGE DEVICE WITH NOZZLE TIP

(71) Applicants: Kotaro Fujiwara, Tokyo (JP); Yoshiyuki Kakuta, Tokyo (JP)

(72) Inventors: Kotaro Fujiwara, Tokyo (JP); Yoshiyuki Kakuta, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 9 days.

(21) Appl. No.: 15/755,253

(22) PCT Filed: Aug. 23, 2016

(86) PCT No.: PCT/JP2016/074507
§ 371 (c)(1),
(2) Date: Feb. 26, 2018

(87) PCT Pub. No.: WO2017/056788
PCT Pub. Date: Apr. 6, 2017

(65) Prior Publication Data

US 2018/0264487 A1 Sep. 20, 2018

(30) Foreign Application Priority Data

Sep. 30, 2015 (JP) ..... 2015-193628

(51) Int. Cl.
*B05B 1/34* (2006.01)
*B05B 1/12* (2006.01)
(Continued)

(52) U.S. Cl.
CPC ..... *B05B 1/3436* (2013.01); *B05B 1/12* (2013.01); *B05B 1/34* (2013.01); *B05B 11/0029* (2013.01);
(Continued)

(58) Field of Classification Search
CPC ..... B05B 1/3415; B05B 1/12; B05B 1/3405; B05B 1/341; B05B 1/3421; B05B 1/3431;
(Continued)

(56) References Cited

U.S. PATENT DOCUMENTS 2,626,185 A * 1/1953 Roselund ..... B05B 1/3046 239/117
3,685,739 A * 8/1972 Vanier ..... B05B 1/12 239/333
(Continued)

FOREIGN PATENT DOCUMENTS

DE 3314020 A1 10/1984
JP 62-027762 U 2/1987
(Continued)

OTHER PUBLICATIONS

Nov. 22, 2016 Searh Report issued in Japanese Patent Application No. PCT/JP2016/074507.
(Continued)

*Primary Examiner* — Paul R Durand
*Assistant Examiner* — Andrew P Bainbridge
(74) *Attorney, Agent, or Firm* — Oliff PLC

(57) ABSTRACT

A discharge device main body having a flow tube through which contents from a container flow inside and which is mounted on the container, a support body extending along the flow tube and fitted to the inside of the flow tube, and a nozzle tip having a nozzle tip body formed in a cylindrical shape with a top including a circumferential wall portion fitted to an outer circumferential surface of the support body and a top wall portion in which a discharge hole of the contents is formed, the nozzle tip being mounted on a distal end portion of the flow tube in a state of being combined with the support body in which a discharge path to communicate the inside of the flow tube and the discharge hole
(Continued)

with each other is formed, and the support body is formed separately from the flow tube and the nozzle tip.

5 Claims, 9 Drawing Sheets

(51) Int. Cl.
*B05B 7/00* (2006.01)
*B05B 11/00* (2006.01)

(52) U.S. Cl.
CPC ..... *B05B 11/3011* (2013.01); *B05B 7/0018* (2013.01); *B05B 11/0044* (2018.08); *B05B 11/3074* (2013.01); *B05B 11/3077* (2013.01)

(58) Field of Classification Search
CPC ..... B05B 11/0029; B05B 11/3004; B05B 11/3011; B05B 11/3095; B05B 11/0044; B05B 11/3074; B05B 11/3077; B05B 7/0018; B05B 11/3009
USPC ..... 222/380, 382, 383.1, 385, 321.8; 239/461, 463, 487, 489
See application file for complete search history.

(56) References Cited

U.S. PATENT DOCUMENTS 3,840,157 A * 10/1974 Hellenkamp ..... B05B 1/3436 222/309
4,227,650 A * 10/1980 McKinney ..... B05B 1/12 222/380
4,257,539 A * 3/1981 Cary ..... B05B 11/3011 222/182
4,260,110 A * 4/1981 Werding ..... B05B 1/3436 239/404
4,911,361 A * 3/1990 Tada ..... B05B 1/12 222/381
5,388,766 A * 2/1995 Buisson ..... B05B 1/3436 222/321.2
5,549,249 A * 8/1996 Foster ..... B05B 1/3431 239/463
5,755,384 A * 5/1998 Foster ..... B05B 1/02 239/343
6,715,698 B2 * 4/2004 Foster ..... B05B 1/3468 239/333
6,722,585 B1 * 4/2004 Stradella ..... B05B 1/3436 239/533.13
8,684,235 B2 * 4/2014 Inaba ..... B05B 11/0029 222/153.13
8,807,457 B2 * 8/2014 Songbe ..... B05B 1/3436 239/463
2003/0098368 A1 * 5/2003 Foster ..... B05B 1/3468 239/320
2006/0086762 A1 * 4/2006 Foster ..... B05B 7/0025 222/383.1
2008/0006719 A1 * 1/2008 Clerget ..... B05B 1/14 239/337
2013/0087638 A1 * 4/2013 Miyamoto ..... B05B 1/3426 239/490
2014/0070025 A1 * 3/2014 Dalbo ..... B05B 1/3421 239/337
2014/0252128 A1 * 9/2014 Ivri ..... B05B 11/3005 239/308
2015/0014444 A1 * 1/2015 Kobayashi ..... F02M 61/163 239/461

FOREIGN PATENT DOCUMENTS

JP H01-127065 A 5/1989
JP H09308841 A 12/1997
JP H10128187 A 5/1998
JP 2003-230854 A 8/2003
JP 2008-296144 A 12/2008
JP 2012-179510 A 9/2012
JP 2013-136043 A 7/2013

OTHER PUBLICATIONS

Apr. 29, 2019 Extended Search Report issued in European Patent Application No. 16850964.4.
Oct. 9, 2019 Office Action issued in Chinese Patent Application No. 201680055429.8.

* cited by examiner

DISCHARGE DEVICE WITH NOZZLE TIP

TECHNICAL FIELD

The present invention relates to a discharge device. Priority is claimed on Japanese Patent Application No. 2015-193628, filed Sep. 30, 2015, the content of which is incorporated herein by reference.

BACKGROUND ART

Conventionally, a discharge device including a flow tube through which contents from a container flow inside, a nozzle tip mounted on a distal end portion of the flow tube and having a cylindrical shape with a top in which a discharge hole is formed on a top wall portion, and a support body disposed inside the distal end portion of the flow tube, fitted inside a circumferential wall portion of the nozzle tip, and formed integrally with the flow tube, in which a spin flow path which allows communication between an inside of the flow tube and the discharge hole is formed between an inner surface of the nozzle tip and an outer surface of the support body is known (for example, Patent Literature 1 below).

CITATION LIST

Patent Literature

[Patent Literature 1]
Japanese Unexamined Patent Application, First Publication No 2003-230854

SUMMARY OF INVENTION

Technical Problem

However, in a conventional discharge device, when an internal pressure of a flow tube unexpectedly increases, a nozzle tip may move with respect to the flow tube and a support body to be separated from the support body. In this case, a deviation occurs in a relative positional relationship between the nozzle tip and the support body. Thereby, a shape of a flow path of a spin flow path is changed due to, for example, a top wall portion of the nozzle tip being separated from the support body or the like, and proper spinning cannot be easily applied to contents. Therefore, there are cases in which the contents cannot be discharged in a desired discharge mode.

In consideration of the above-described circumstances, the present invention is directed to providing a discharge device capable of stably discharging the contents in a constant discharge mode without being affected by a change in internal pressure of the flow tube.

Solution to Problem

In order to solve the above problem, the present invention proposes the following means. A first aspect of the present invention is a discharge device which includes a discharge device main body including a flow tube, an inside thereof through which contents from a container flow, and the discharge device main body which is mounted on the container, a support body extending along the flow tube and fitted to the inside of the flow tube, and a nozzle tip having a nozzle tip body formed in a cylindrical shape with a top including a circumferential wall portion fitted to an outer circumferential surface of the support body and a top wall portion in which a discharge hole for the contents is formed, the nozzle top being mounted on a distal end portion of the flow tube in a state of being combined with the support body. A discharge path to communicate the inside of the flow tube and the discharge hole with each other is formed between an inner surface of the nozzle tip body and an outer surface of the support body. The support body is formed separately from the flow tube and the nozzle tip.

According to the discharge device according to the first aspect of the present invention, when an internal pressure of the flow tube increases, the contents can be introduced from the inside of the flow tube to the discharge hole through the discharge path and can be discharged from the discharge hole to the outside. Particularly, since the support body is formed separately from the flow tube and the nozzle tip, even when the internal pressure of the flow tube unexpectedly increases at the time of discharging the contents, the nozzle tip and the support body can be integrally displaced with respect to the flow tube while the nozzle tip and the support body are combined with each other without change. Accordingly, it is possible to maintain a relative positional relationship between the nozzle tip and the support body, and it is possible to prevent a discharge passage for the contents moving from the discharge path to the discharge hole from being changed. Therefore, even when the internal pressure of the flow tube unexpectedly increases, the contents can be appropriately introduced into the discharge hole through the discharge path, and the contents can be stably discharged in a desired discharge mode.

According to a second aspect of the present invention, in the discharge device of the first aspect, the support body may include a shaft portion disposed inside the circumferential wall portion of the nozzle tip body and into which the circumferential wall portion is fitted from outside in a radial direction and an annular flange portion protruding toward the outside in the radial direction from a rear end portion of the shaft portion and fitted to the inside of the flow tube. The discharge path may be formed between an inner surface of the nozzle tip body and an outer surface of the shaft portion. A plurality of communication holes penetrating the flange portion and to communicate the inside of the flow tube and an inside of the discharge path with each other may be formed in the flange portion at intervals in a circumferential direction. A communication groove connecting the plurality of communication holes with each other may be formed in a rear end surface of the shaft portion.

According to the discharge device of the second aspect of the present invention, since the contents can be introduced from the inside of the flow tube to a space between the shaft portion and the circumferential wall portion through the plurality of communication holes, the contents can be introduced into the discharge hole via the discharge path. Particularly, since the communication groove for allowing the plurality of communication holes to communicate with each other is formed on the rear end surface of the shaft portion, the contents can be introduced substantially evenly into the plurality of communication holes through the communication groove. Therefore, the contents can be introduced into the discharge path from each communication hole without deviation, and the contents can be stably discharged without irregular discharge.

According to a third aspect of the present invention, in the discharge device of the first aspect, the support body may include a shaft portion disposed inside the circumferential wall portion of the nozzle tip body and into which the circumferential wall portion is fitted from outside in a radial direction, a surrounding tube surrounding the shaft portion from the outside in the radial direction, disposed between the circumferential wall portion of the nozzle tip body and the flow tube, and fitted inside the flow tube, and an annular connecting portion connecting a rear end portion of the shaft portion and a rear end portion of the surrounding tube in the radial direction. The discharge path may be formed between an inner surface of the nozzle tip body and an outer surface of the shaft portion. A communication hole penetrating the connecting portion and to communicate the inside of the flow tube and an inside of the discharge path with each other may be formed in the connecting portion. An engaged portion which engages an engaging portion formed in the nozzle tip may be formed in the surrounding tube.

According to the discharge device of the third aspect of the present invention, in addition to the fitting of the circumferential wall portion of the nozzle tip and an outer circumferential surface of the shaft portion of the support body, since the engaging portion of the nozzle tip can be engaged with an engaged portion formed in the surrounding tube, it is possible to more strongly and integrally combine the support body and the nozzle tip. Therefore, even when the internal pressure of the flow tube unexpectedly increases, the nozzle tip and the support body are more easily and integrally displaced with respect to the flow tube. Further, even in this case, since the contents can be introduced from the inside of the flow tube to a space between the shaft portion and the circumferential wall portion through the communication hole, the contents can be introduced into the discharge hole via the discharge path.

According to a fourth aspect of the present invention, in the discharge device of any one of the first to third aspects, at least a portion of the discharge path may be formed by a spin groove which causes the contents to flow in the circumferential direction of the flow tube.

According to the discharge device of the fourth aspect of the present invention, even when the contents are discharged in a state of being applied with a spin that turns around in the circumferential direction of the flow tube, it is possible for the contents to maintain a desired discharge mode without being affected by a change in internal pressure of the flow tube.

Advantageous Effects of the Invention

According to the discharge device of the present invention, it is possible to stably discharge the contents in a constant discharge mode without being affected by a change in internal pressure of the flow tube.

DESCRIPTION OF EMBODIMENTS

Hereinafter, a first embodiment of a discharge device according to the present invention will be described with reference to the drawings. In the present embodiment, a trigger-type liquid ejector will be taken as an example of the discharge device in the following description.

First Embodiment

Figure 1:
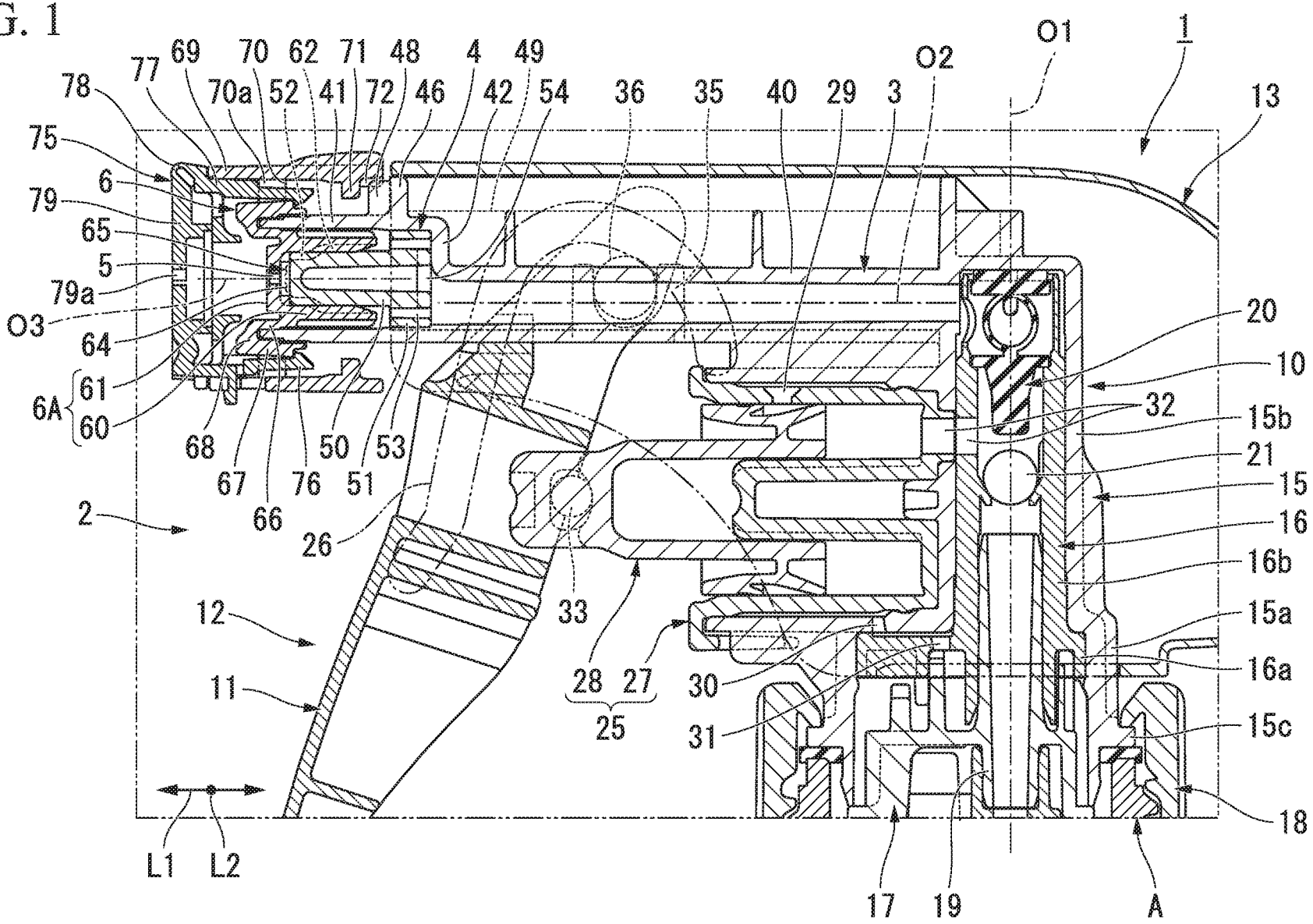
FIG. 1 is a longitudinal sectional view showing a first embodiment of a trigger-type liquid ejector which is a discharge device according to the present invention.

As shown in FIG. 1, a trigger-type liquid ejector 1 of the present embodiment includes an ejector main body (discharge device main body) 2 mounted on a container A in which a liquid (contents, not shown) is contained, a support body 4 fitted inside a distal end portion of an injection tubular portion (flow tube) 3 in the ejector main body 2, and a nozzle tip 6 having an ejection hole (discharge hole) 5 for the contents formed therein and mounted on a distal end portion of the injection tubular portion 3 in a state of being combined with the support body 4. Further, each of the components in the trigger-type liquid ejector 1 is a molded product using a synthetic resin unless otherwise specified.

In the present embodiment, a central axis of a suction-up tubular portion 10 to be described below is referred to as an axis O1, a container A side along the axis O1 is referred to as a lower side, and the opposite side thereto is referred to as an upper side. Among two directions perpendicular to the axis O1, one direction is referred to as a forward and rearward direction L1, and the other direction is referred to as a lateral direction L2. In other words, among directions perpendicular to a direction along the axis O1 (vertical direction), a direction along the injection tubular portion 3 is referred to as the forward and rearward direction L1 and a direction perpendicular to the forward and rearward direction (that is, a direction perpendicular to both the vertical direction and the forward and rearward direction) is referred to as the lateral direction L2.

The ejector main body 2 includes the suction-up tubular portion 10 which extends in the vertical direction and suctions up the liquid in the container A, the injection tubular portion 3 which extends in the forward and rearward direction L1 from the suction-up tubular portion 10 and communicates with an inside of the suction-up tubular portion 10, a trigger mechanism 12 which has a trigger portion 11 extending downward from the injection tubular portion 3 and disposed to be swingable rearward in a state of being biased forward, and a cover body 13 which covers the suction-up tubular portion 10, the injection tubular portion 3, and a reciprocating pump 25 to be described below from above, a rear, and right and left. In the present embodiment, in the forward and rearward direction L1, a direction in which the injection tubular portion 3 extends from the suction-up tubular portion 10 is referred to as a front side or forward, and the opposite direction thereto is referred to as a rear side or rearward.

The suction-up tubular portion 10 includes an outer tube 15 having a cylindrical shape with a top, an inner tube 16 disposed inside the outer tube 15, and a pipe unit 17 disposed inside the inner tube 16. The outer tube 15 is formed in a two-stage tubular shape having a large diameter portion 15*a* and a small diameter portion 15*b* disposed above the large diameter portion 15*a* and having an outer diameter smaller than that of the large diameter portion 15*a*. In the large diameter portion 15*a* of the outer tube 15, a flange portion 15*c* protruding toward an outside and disposed on an opening end edge of a mouth portion of the container A with a packing therebetween is formed, and a mounting cap 18 mounted on (for example, screwed into) the mouth portion of the container A to sandwich the flange portion 15*c* with the opening end edge is attached.

The inner tube 16 is formed in a two-stage tubular shape having a large diameter portion 16*a* disposed inside the large diameter portion 15*a* of the outer tube 15 and a small diameter portion 16*b* disposed inside the small diameter portion 15*b* of the outer tube 15. The pipe unit 17 includes a pipe 19 having a lower end opening open toward a bottom side of the container A and fitted inside the small diameter portion 16*b* of the inner tube 16. As a result, the inside of the inner tube 16 communicates with the inside of the container A through the pipe 19 and also communicates with an inside of the injection tubular portion 3.

A first suction valve 20 is disposed inside the inner tube 16 and a second suction valve 21 is disposed at a portion positioned below the first suction valve 20 inside the inner tube 16. The first suction valve 20 allows and blocks communication between a space positioned above the first suction valve 20 and a space positioned below the first suction valve 20 in the inner tube 16. That is, when an inside of a cylinder 27 of the reciprocating pump 25 to be described below is pressurized, the first suction valve 20 is opened to connect the inside of the inner tube 16 to the inside of the injection tubular portion 3, and when the inside of the cylinder 27 is depressurized, the first suction valve 20 is closed to block communication between the inside of the inner tube 16 and the inside of the injection tubular portion 3.

The second suction valve 21 allows and blocks communication between a space positioned between the first suction valve 20 and the second suction valve 21 and a space positioned below the second suction valve 21 in the inner tube 16. That is, when the inside of the cylinder 27 of the reciprocating pump 25 is pressurized, the second suction valve 21 is closed to block communication between the inside of the inner tube 16 and the inside of the pipe 19, and when the inside of the cylinder 27 is depressurized, the second suction valve 21 is opened to connect the inside of the inner tube 16 to the inside of the pipe 19.

The trigger mechanism 12 includes the trigger portion 11, the reciprocating pump 25 whose inside is pressurized and depressurized in accordance with swinging of the trigger portion 11, and an elastic member 26 which biases the trigger portion 11 forward. The reciprocating pump 25 is assembled to a front surface side of the outer tube 15 of the suction-up tubular portion 10, and includes a cylinder 27 which opens forward and a plunger 28 assembled in the cylinder 27 to be slidable back and forth from a front side.

The inside of the cylinder 27 communicates with an inside of the mounting cap 18 through a first vent hole 29 formed in the cylinder 27, a second vent hole 30 formed in the outer tube 15 of the suction-up tubular portion 10, and the third vent hole 31 formed in the inner tube 16 of the suction-up tubular portion 10. Further, the inside of the cylinder 27 also communicates with a space between the first suction valve 20 and the second suction valve 21 in the inner tube 16 through a through hole 32 which continuously penetrates the outer tube 15 and the inner tube 16.

The plunger 28 is, for example, in liquid-tight sliding contact with an inner circumferential surface of the cylinder 27, and a front end portion thereof is connected to the trigger portion 11 via a connecting shaft 33. As a result, the plunger 28 moves back and forth with respect to the cylinder 27 in accordance with swinging of the trigger portion 11, and thus the inside of the cylinder 27 is pressurized and depressurized. Further, when the trigger portion 11 is at a foremost swing position, the plunger 28 closes the first vent hole 29. Then, when the plunger 28 moves rearward by a predetermined amount due to rearward swinging of the trigger portion 11, the plunger 28 opens the first vent hole 29. As a result, since the inside of the container A communicates with the outside through the third vent hole 31, the second vent hole 30, and the first vent hole 29, air can be introduced into the container A.

A rotating shaft portion 36 rotatably supported by a bearing portion 35 formed integrally with the injection tubular portion 3 is formed at an upper end portion of the trigger portion 11. Thereby, the trigger portion 11 can swing in the forward and rearward direction L1 around the rotating shaft portion 36. A pair of elastic members 26 are provided to sandwich the injection tubular portion 3 in the lateral direction L2 in a state in which one end portion thereof is fixed to the injection tubular portion 3 and the other end portion thereof is fixed to the trigger portion 11, and biases the trigger portion 11 toward the front.

Figure 2:
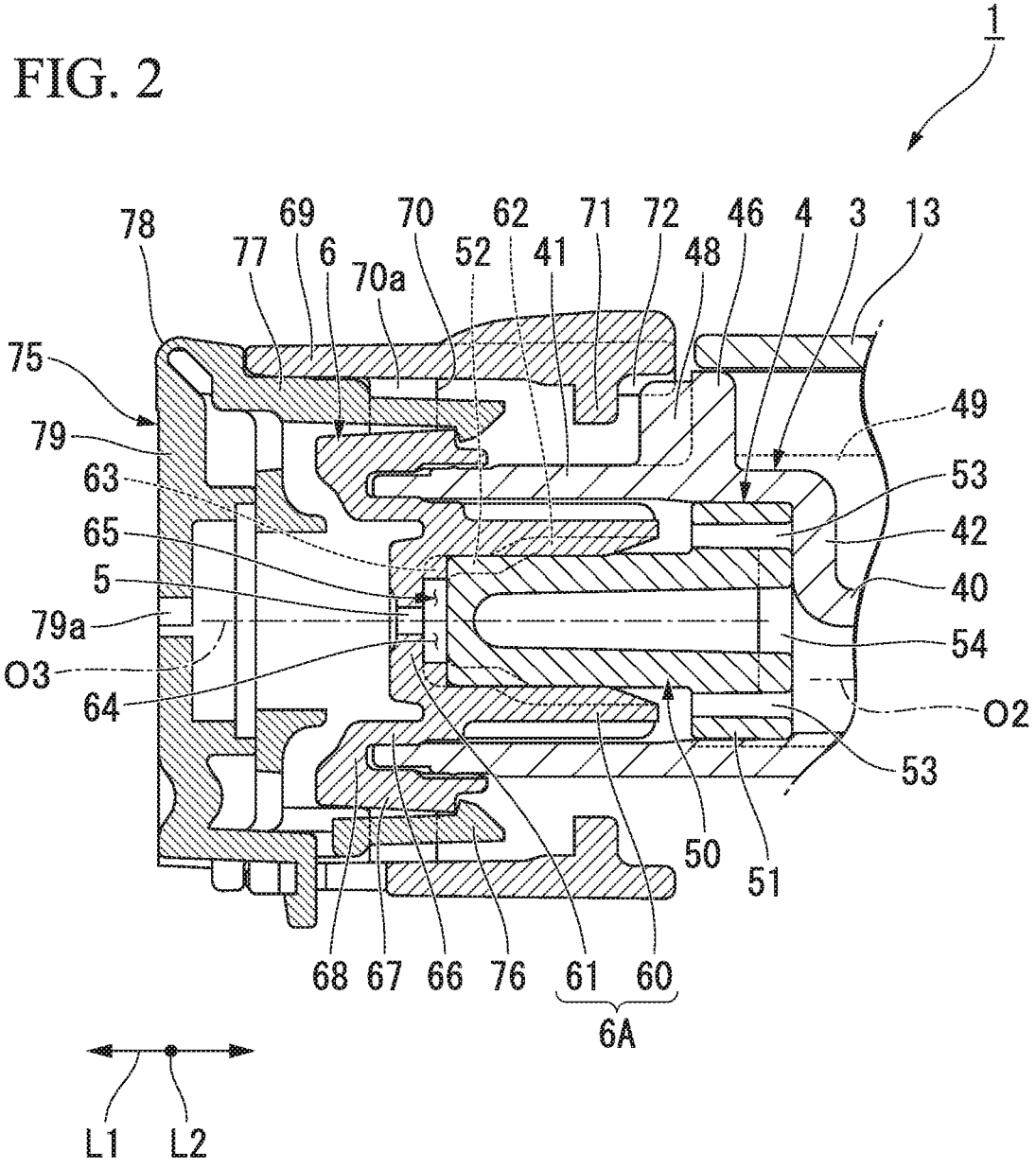
FIG. 2 is an enlarged longitudinal sectional view of a periphery of a distal end portion of an injection tubular portion shown in FIG. 1.

As shown in FIGS. 1 and 2, the injection tubular portion 3 extends in the forward and rearward direction L1 and opens forward. The injection tubular portion 3 includes a base end tubular portion 40 extending forward from an upper end portion of the outer tube 15 of the suction-up tubular portion 10 along a central axis (hereinafter referred to as an axis O2), and a cylindrical distal end tubular portion 41 extending further forward from a front end portion of the base end tubular portion 40 along a central axial (hereinafter referred to as an axis O3). In the present embodiment, a direction perpendicular to the axis O3 is referred to as a radial direction in a plan view when viewed from an axis O3 direction, and a direction of revolving around the axis O3 is referred to as a circumferential direction.

The axis O3 of the distal end tubular portion 41 is eccentric upward with respect to the axis O2 of the base end tubular portion 40. As a result, the injection tubular portion 3 is formed in a stepped shape in which the distal end tubular portion 41 is shifted upward with respect to the base end tubular portion 40. Therefore, a connecting wall portion 42 facing forward is formed at a connecting portion between the distal end tubular portion 41 and the base end tubular portion 40.

Figure 3:
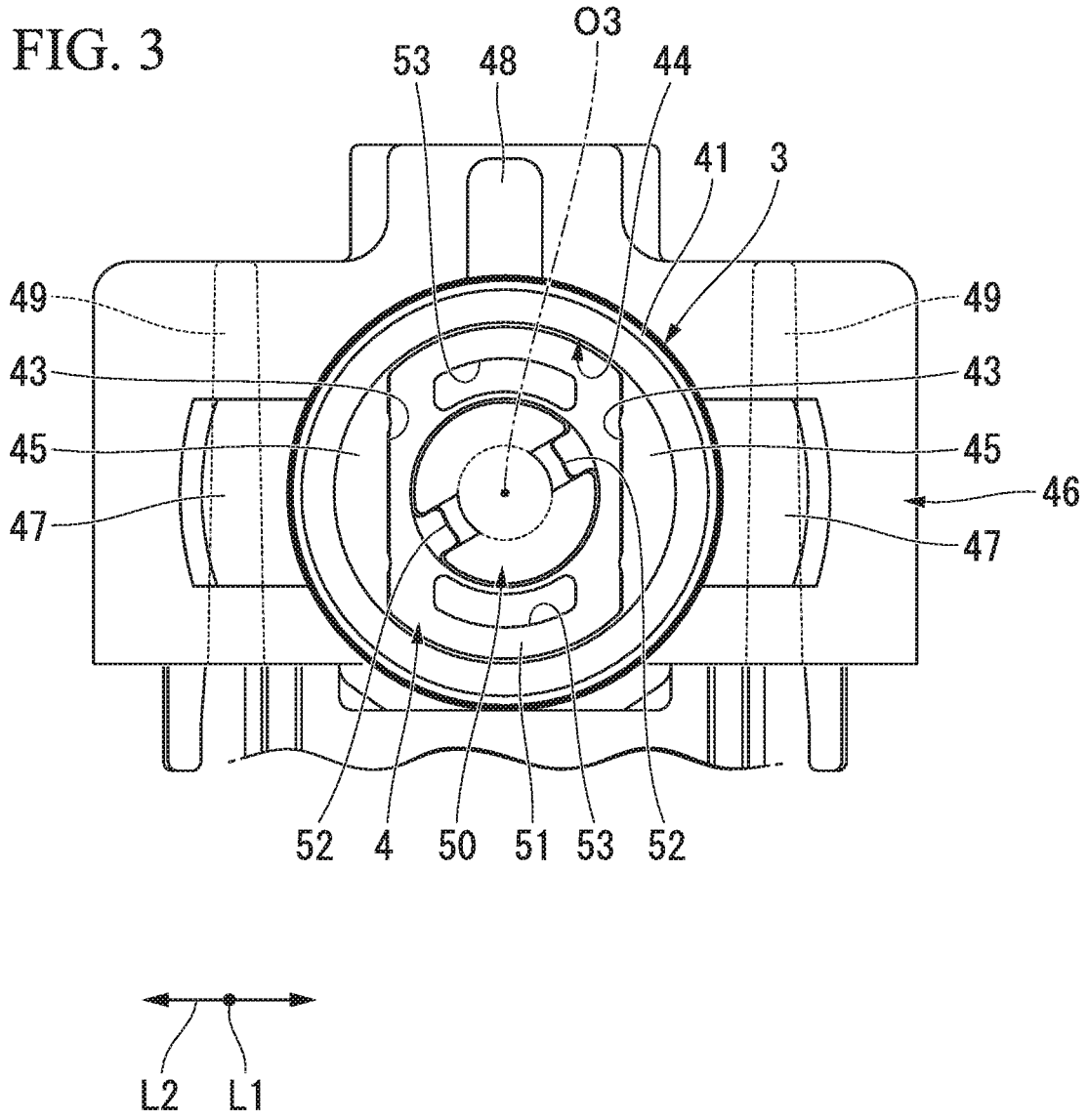
FIG. 3 is a front view of the injection tubular portion shown in FIG. 2 when viewed from the front and is a front view showing a distal end tubular portion of the injection tubular portion and a support body disposed inside the distal end tubular portion with a nozzle tip removed.

As shown in FIG. 3, a pair of facing wall portions 43 facing each other in the lateral direction L2 are formed to protrude toward an inner side of the distal end tubular portion 41 at a portion positioned on the connecting wall portion 42 side in the inner circumferential surface of the distal end tubular portion 41. Rear end portions of the pair of facing wall portions 43 are installed to be continuous with the connecting wall portion 42. Therefore, in the connecting portion between the distal end tubular portion 41 and the base end tubular portion 40, an opening 44 which is formed longer in the vertical direction than the lateral direction L2 is defined inside the distal end tubular portion 41. Further, end wall portions 45 facing forward are installed to be continuous with front end portions of the pair of facing wall portions 43.

As shown in FIG. 1, a bearing portion 35 which rotatably supports the rotating shaft portion 36 of the trigger portion 11 is formed at a portion of an outer circumferential surface of the base end tubular portion 40 facing the lateral direction L2. Also, as shown in FIGS. 1 to 3, a partition wall 46 protruding upward and in the lateral direction L2 is formed and a pair of engaging pieces 47 (see FIG. 3) protruding in the lateral direction L2 are formed in the distal end tubular portion 41.

The partition wall 46 is formed to protrude in the lateral direction L2 with respect to the pair of engaging pieces 47. A longitudinally long first rib 48 protrudes forward at a portion of the partition wall 46 protruding upward with respect to the distal end tubular portion 41. A front end portion of a cover wall 49 extending in the forward and rearward direction L1 and covering the upper end portion of the trigger portion 11, one end portion of the elastic member 26, and the base end tubular portion 40 from the outside in the lateral direction L2 is connected to a portion of the partition wall 46 protruding laterally with respect to the distal end tubular portion 41. A rear end portion of the cover wall 49 is connected to a rear end portion of the base end tubular portion 40 and the outer tube 15 of the suction-up tubular portion 10. Therefore, the trigger portion 11 and the elastic member 26 are disposed in a space formed between the base end tubular portion 40 and the cover wall 49.

As shown in FIG. 3, the pair of engaging pieces 47 are disposed on a front side of the partition wall 46 so that a gap is formed between the pair of engaging pieces 47 and the partition wall 46. Distal end portions of the pair of engaging pieces 47 are formed in an arc shape along the circumferential direction. As shown in FIG. 1, the cover body 13 is assembled to cover the suction-up tubular portion 10, the injection tubular portion 3, and the reciprocating pump 25 from the upper side, the rear side, and in the lateral direction in a state of being disposed at an upper end portion of the partition wall 46.

As shown in FIG. 2 to FIG. 6, the support body 4 is fitted inside the distal end tubular portion 41 which is the distal end portion of the injection tubular portion 3 and disposed coaxially with the axis O3. The support body 4 includes a shaft portion 50 extending along the axis O3 and a flange portion 51 protruding toward the outside in the radial direction from a rear end portion of the shaft portion 50, and is formed separately from the injection tubular portion 3 and the nozzle tip 6.

The shaft portion 50 is formed in a cylindrical shape with a top in which its front end is closed. However, a shape of the shaft portion 50 is not limited to a cylindrical shape with a top, and it may be formed in a solid columnar shape, for example. The flange portion 51 is formed to have an outer shape corresponding to a shape of the opening 44 of the distal end tubular portion 41, that is, formed such that a vertical length is longer than a length in the lateral direction L2. Specifically, in a plan view of the flange portion 51 when viewed from the axis O3 direction, portions of an outer peripheral surface of the flange portion 51 positioned on the left and right sides are formed to be flat, and portions positioned above and below thereof are formed into a curved surface in the circumferential direction.

Thus, the flange portion 51 is fitted inside the opening 44 in a state of being in contact with the connecting wall portion 42 from the front. Therefore, the support body 4 is positioned inside the distal end tubular portion 41 in the forward and rearward direction L1 and is fitted in a state in which it is prevented from rotating.

Figure 4:
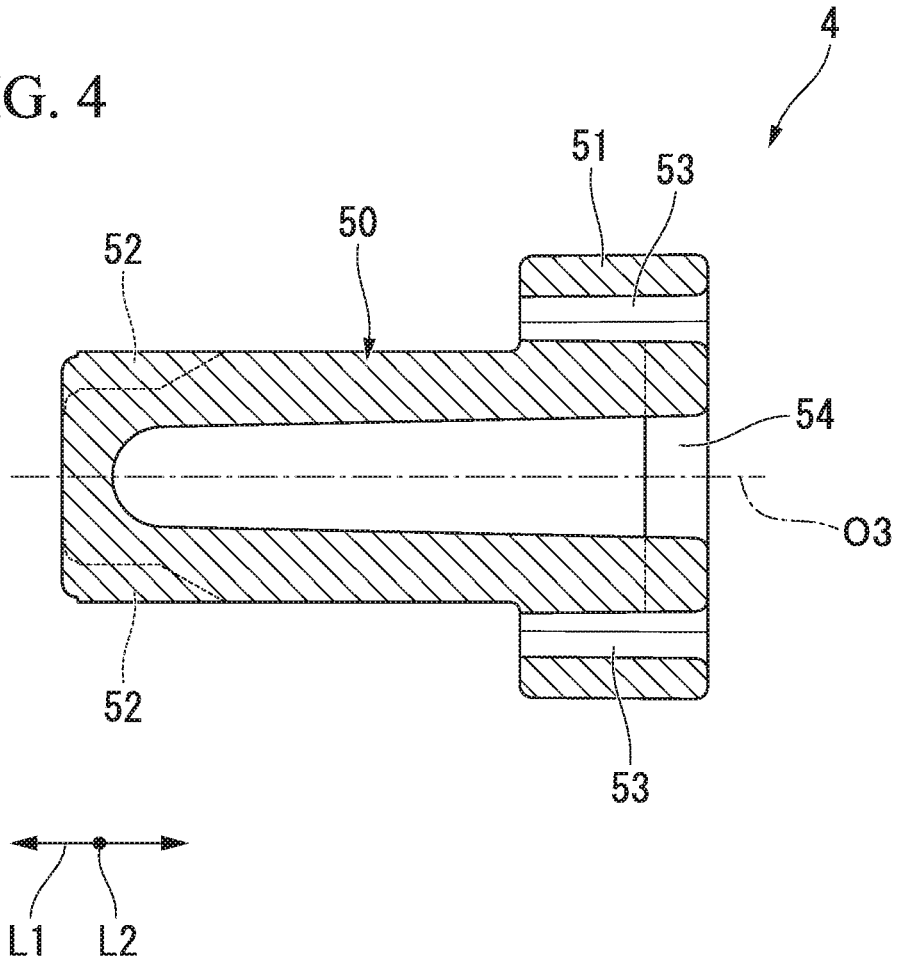
FIG. 4 is a longitudinal sectional view of the support body shown in FIG. 2.
Figure 6:
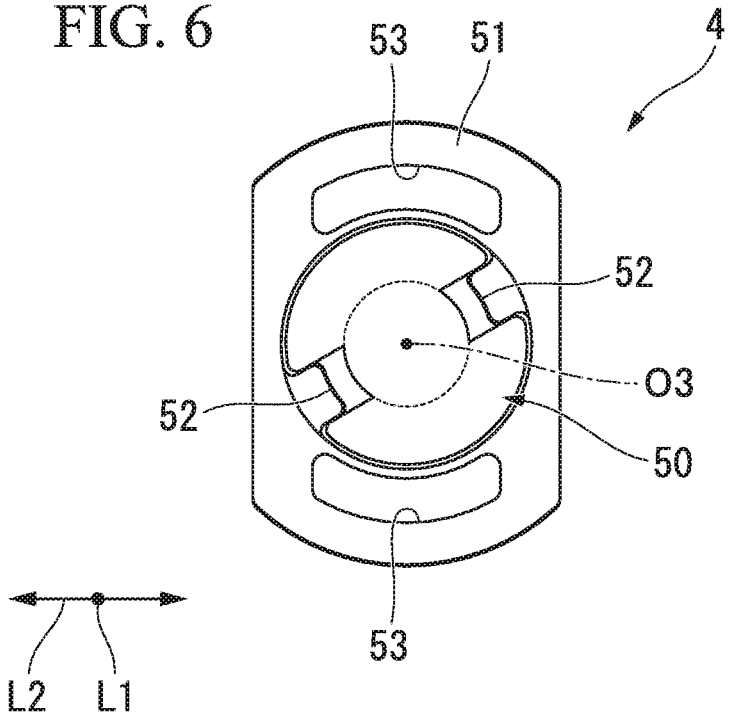
FIG. 6 is a front view of the support body shown in FIG. 4 when viewed from the front.

As shown in FIGS. 4 and 6, a first groove portion 52 linearly extending in the axis O3 direction and opening forward is formed on an outer circumferential surface of the shaft portion 50. In the shown example, two first groove portions 52 are formed at regular intervals in the circumferential direction. However, the number of first groove portions 52 is not limited to two, and may be one or three or more.

Figure 5:
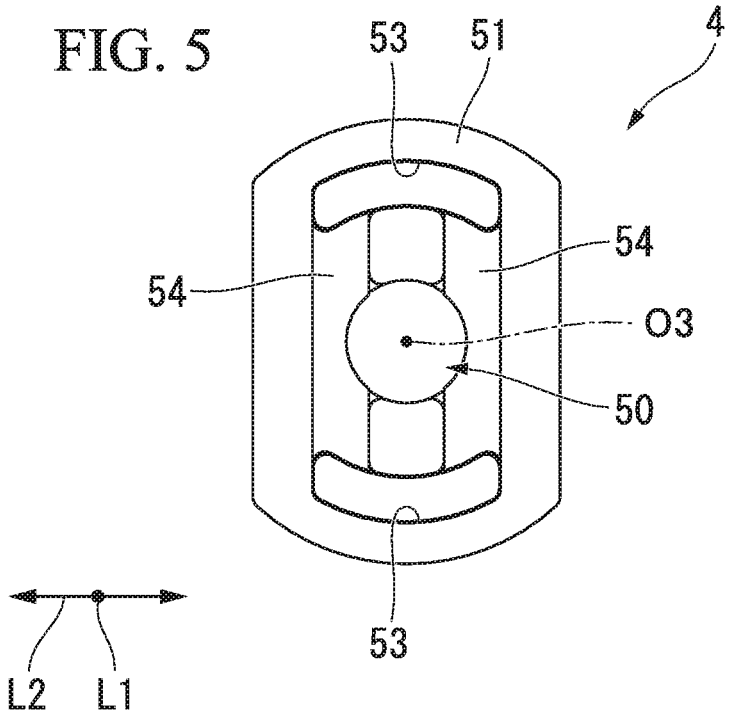
FIG. 5 is a rear view of the support body shown in FIG. 4 when viewed from the rear.

As shown in FIGS. 4 to 6, the flange portion 51 has a communication hole 53 formed to penetrate the flange portion 51 in the forward and rearward direction L1. In the shown example, the communication hole 53 is formed in a long hole shape extending in the circumferential direction and is disposed at two places above and below the shaft portion 50 with the shaft portion 50 interposed therebetween. However, the number and shape of the communication holes 53 are not limited thereto. Further, the above-described first groove portions 52 are formed at positions deviated from the communication holes 53 in the circumferential direction. As shown in FIGS. 4 and 5, a communication groove 54 for vertically connecting the two communication holes 53 formed in the flange portion 51 is formed on a rear end surface of the shaft portion 50, that is, on an opening edge on the rear end side to be aligned in the lateral direction L2 with the central axis O3 interposed therebetween.

As shown in FIG. 2, the nozzle tip 6 includes a nozzle tip body 6A formed in a cylindrical shape with a top having a circumferential wall portion 60 rotatably fitted around the axis O3 with respect to the outer circumferential surface of the shaft portion 50 of the support body 4, and a top wall portion 61 in which the ejection hole 5 is formed. The nozzle tip 6 is mounted to be rotatable around the axis O3 from the front with respect to the distal end tubular portion 41 of the injection tubular portion 3 in a state of being combined with the shaft portion 50 of the support body 4. Therefore, the nozzle tip 6 is relatively rotatable around the axis O3 with respect to the support body 4 and the injection tubular portion 3.

A second groove portion 62 linearly extending along the axis O3 and opening rearward is formed on an inner circumferential surface of the circumferential wall portion 60. In the shown example, two second groove portions 62 are formed at regular intervals in the circumferential direction. These second groove portions 62 are formed so that circumferential positions thereof are coincident with those of the first groove portions 52 formed in the support body 4, and communicate with the first groove portions 52. Therefore, the communication holes 53 and the first groove portions 52 communicate with each other via the second groove portions 62.

At a central portion of the top wall portion 61, the ejection hole 5 is formed coaxially with the axis O3. A first spin groove (spin groove) 63 communicating with the first groove portion 52, and a second spin groove (spin groove) 64 communicating with the first spin groove 63 and the ejection hole 5 are formed on a rear surface of the top wall portion 61. The first spin groove 63 is formed to extend in the circumferential direction, and by causing a liquid from the first groove portion 52 to flow in the circumferential direction, a spin that turns in the circumferential direction is applied to the liquid. The second spin groove 64 is disposed at the central portion of the top wall portion 61, is formed to be recessed toward the front, and introduces the liquid to which the spin from the spin groove 63 has been applied into the ejection hole 5.

Therefore, an inside of the base end tubular portion 40 of the injection tubular portion 3 communicates with the ejection hole 5 through the communication hole 53, the second groove portion 62, the first groove portion 52, the first spin groove 63, and the second spin groove 64. Further, the second groove portion 62, the first groove portion 52, the first spin groove 63, and the second spin groove 64 are formed between an inner surface of the nozzle tip body 6A and an outer surface of the shaft portion 50 of the support body 4, and function as an ejection path (discharge path) 65 that allows communication between the inside of the base end tubular portion 40 and the ejection hole 5.

The nozzle tip 6 includes the nozzle tip body 6A, an inner tube portion 66 connected to the circumferential wall portion 60 and fitted inside the distal end tubular portion 41 to be rotatable around the axis O3, an outer tube portion 67 surrounding the distal end tubular portion 41 from the outside in the radial direction, an annular connecting wall portion 68 which connects a front end portion of the inner tube portion 66 and a front end portion of the outer tube portion 67 in the radial direction and is positioned in front of an opening end of the distal end tubular portion 41, an outer shell tubular portion 69 which further surrounds the outer tube portion 67 and the distal end tubular portion 41 from the outside in the radial direction, and a connecting ring 70 which connects the outer tube portion 67 and the outer shell tubular portion 69 in the radial direction.

The outer shell tubular portion 69 extends in the forward and rearward direction L1 so that a rear end portion is positioned slightly in front of the partition wall 46 and a front end portion is positioned in front of the connecting wall portion 68. An annular engaging protrusion 71 which protrudes toward the inside in the radial direction and engages with the pair of engaging pieces 47 formed in the injection tubular portion 3 from the rear is formed on a rear end portion side of the outer shell tubular portion 69. As a result, the nozzle tip 6 is attached to the injection tubular portion 3 in a state of being prevented from coming out forward with respect to the injection tubular portion 3.

Further, two second ribs 72 which ride over the first rib 48 formed in the injection tubular portion 3 from the circumferential direction are formed at a portion of the outer shell tubular portion 69 positioned on a rear side of the engaging protrusion 71 at intervals in the circumferential direction. Also, when the second ribs 72 ride over the first rib 48, a pair of engaging walls (not shown) which engage with one end edge or the other end edge in the circumferential direction of the engaging piece 47 are provided on the nozzle tip 6 (for example, an inner circumferential surface of the outer shell tubular portion 69). Therefore, the nozzle tip 6 is rotatable back and forth around the axis O3 between a position at which the pair of engaging walls engage with one end edge of each of the engaging pieces 47 and a position at which the pair of engaging walls engage with the other end edge of each of the engaging pieces 47.

As shown in FIG. 2, the second groove portion 62 is formed to communicate with the first groove portion 52 when the pair of engaging walls engage with one end edge of each of the engaging pieces 47, and formed not to communicate with the first groove portion 52 when the pair of engaging walls engage with the other end edge of each of the engaging pieces 47. Therefore, it is possible to switch an ejecting operation of the liquid ON/OFF by rotating the nozzle tip 6 back and forth around the axis O3. At this time, since a click feeling is imparted when the second ribs 72 ride over the first rib 48, it is possible to recognize switching the liquid ejecting operation ON/OFF as a tactile sensation.

Further, in the present embodiment, a switching unit 75 for switching a discharge mode of the liquid to a foamy form is attached. However, the switching unit 75 is not indispensable and may not be provided.

A plurality of mounting holes 70*a* for attaching the switching unit 75 are formed in the connection ring 70 to penetrate the connection ring 70 in the forward and rearward direction L1 at intervals in the circumferential direction. The switching unit 75 includes a mounting claw portion 76 inserted from the front into the mounting hole 70*a* and undercut-fitted in the outer tube portion 67 of the nozzle tip 6, a mounting tubular portion 77 assembled inside the outer shell tubular portion 69 from the front, and a switching plate 79 rotatably connected to the mounting tubular portion 77 via a hinge portion 78 and in which a foam hole 79*a* is provided.

When the switching unit 75 is used, a state of foam can be changed by opening and closing the switching plate 79. That is, by mixing the liquid ejected from the ejection hole 5 and outside air in a space between the ejection hole 5 and the switching plate 79, the liquid can be foamed.

Action of Trigger-Type Liquid Ejector

Next, a case in which the trigger-type liquid ejector 1 configured as described above is used will be described. It is assumed that a liquid is filled into each member of the trigger-type liquid ejector 1 by operating the trigger portion 11 more than once and can be suctioned up by the suction-up tubular portion 10. Further, it is assumed that the second groove portion 62 is in a state of communicating with the first groove portion 52.

When the trigger portion 11 shown in FIG. 1 is pulled rearward against a biasing force of the elastic member 26, since the plunger 28 retreats with respect to the cylinder 27 as the trigger portion 11 moves rearward, the liquid in the cylinder 27 can be introduced into the inner tube 16 of the suction-up tubular portion 10. Thereby, since the second suction valve 21 can be pushed down to close the valve and the first suction valve 20 can be pushed up to open the valve, the liquid can be introduced from the inner tube 16 into the base end tubular portion 40 of the injection tubular portion 3.

Then, since the pressurized liquid is introduced into the injection tubular portion 3, the liquid in the base end tubular portion 40 can be introduced into the ejection hole 5 through the communication hole 53, the second groove portion 62, the first groove portion 52, the first spin groove 63, and the second spin groove 64. As a result, the liquid can be ejected (discharged) to the outside through the ejection hole 5. Moreover, by introducing the liquid from each of the pair of first spin grooves 63 into the second spin groove 64 for applying a spin that turns in the circumferential direction, the spin-applied liquid is ejected in a mist form from the ejection hole 5.

Further, the axis O3 of the distal end tubular portion 41 of the injection tubular portion 3 is eccentric upward with respect to the axis O2 of the base end tubular portion 40. Thereby, the liquid in the base end tubular portion 40 is vigorously introduced into the lower communication hole 53 among the two communication holes 53, and is also introduced into the upper communication hole 53 vigorously via the communication groove 54. Accordingly, since the liquid can be introduced substantially evenly into the pair of second groove portions 62, the liquid is easily ejected in a stable manner.

Particularly, the support body 4 is formed separately from the injection tubular portion 3 and the nozzle tip 6. As a result, even when an internal pressure of the injection tubular portion 3 unexpectedly increases at the time of ejecting the liquid, the nozzle tip 6 and the support body 4 can be integrally displaced with respect to the injection tubular portion 3 while the nozzle tip 6 and the support body 4 are combined with each other without change. That is, when the internal pressure of the injection tubular portion 3 increases, since the pressure acts on the support body 4 from the rear, a fitting between the flange portion 51 of the support body 4 and the opening 44 of the injection tubular portion 3 is relaxed. Thereby, the support body 4 and the nozzle tip 6 can be relatively moved forward with respect to the injection tubular portion 3.

Accordingly, it is possible to maintain a relative positional relationship between the nozzle tip 6 and the support body 4, and it is possible to prevent an ejection passage (discharge passage) of the liquid from the ejection path 65 to the ejection hole 5 from being changed. Therefore, it is possible to prevent such a possibility as the liquid not properly flowing through the first spin groove 63 and the second spin groove 64 and thus not being subjected to spinning due to a cause such as deviation in the relative positional relationship between the second groove portion 62 and the first groove portion 52 or emptiness of a space between the top wall portion 61 of the nozzle tip 6 and a front end of the shaft portion 50, for example.

Therefore, the contents can be appropriately introduced into the ejection hole 5 through the ejection path 65 without being influenced by a change in internal pressure of the injection tubular portion 3 and the contents can be stably ejected in a desired mode.

When the trigger portion 11 is released, the trigger portion 11 is biased forward by an elastic restoring force of the elastic member 26 and returns to its original position. Along with this, the plunger 28 moves forward with respect to the cylinder 27. Therefore, by a negative pressure generated in the cylinder 27, the second suction valve 21 is opened and the first suction valve 20 is closed, and thereby the liquid in the container A can be suctioned up to the suction-up tubular portion 10 through the pipe 19. Thus, the suctioned up liquid can be introduced into the cylinder 27. That is, in a state in which the liquid is filled into the cylinder 27, it is possible to prepare for the next ejection.

As described above, according to the trigger-type liquid ejector 1 of the present embodiment, even when the internal pressure of the injection tubular portion 3 unexpectedly increases, since the relative positional relationship between the nozzle tip 6 and the support body 4 can be maintained, the liquid can be stably ejected in a constant mode. Therefore, stable ejection performance can be maintained regardless of the change in internal pressure of the injection tubular portion 3.

Second Embodiment

Next, a second embodiment of a discharge device according to the present invention will be described. In the second embodiment, components the same as those in the first embodiment will be denoted by the same reference signs, and a description thereof will be omitted here.

Figure 7:
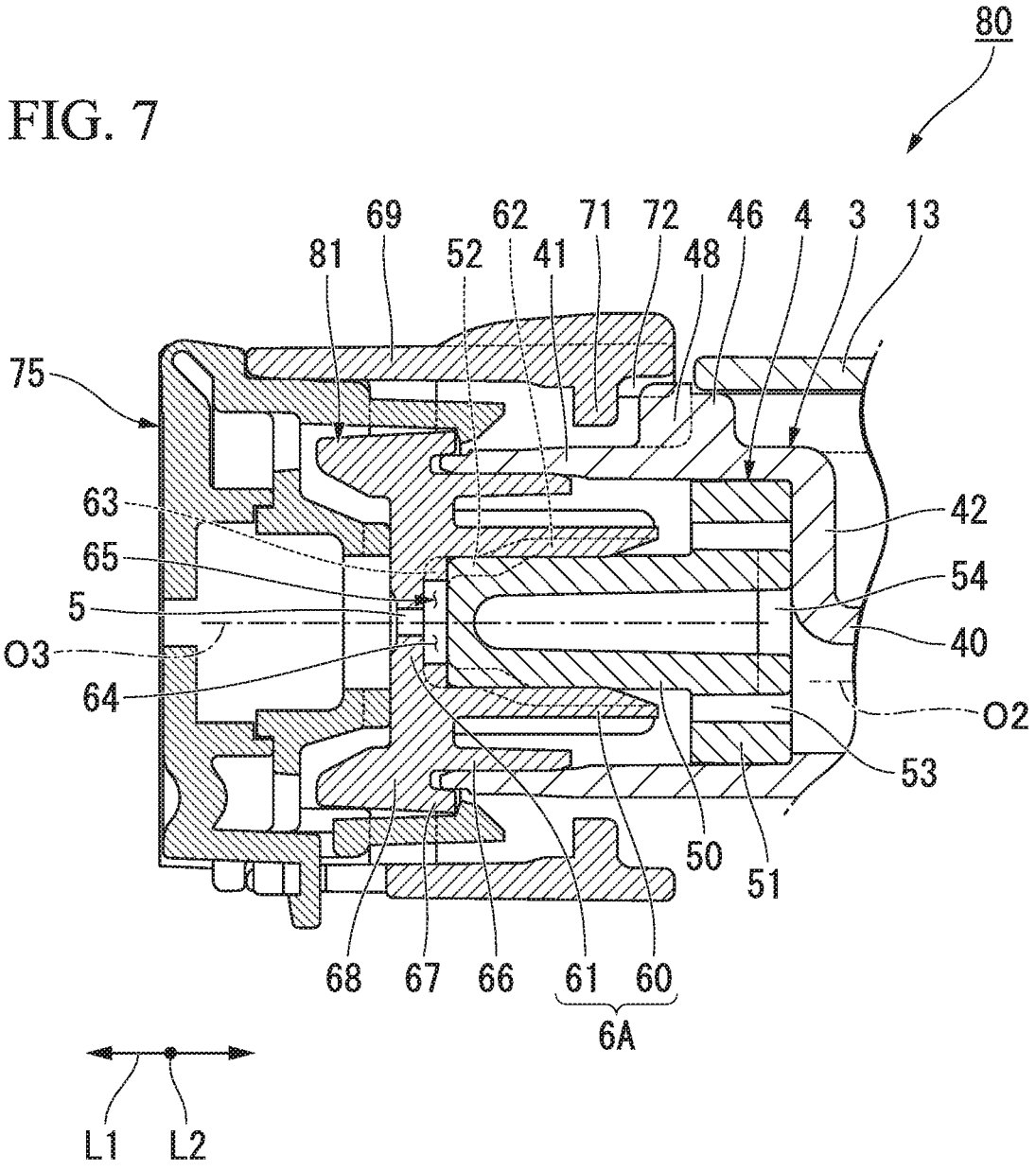
FIG. 7 is a view showing a second embodiment of the trigger-type liquid ejector which is a discharge device according to the present invention, and is an enlarged longitudinal sectional view of a periphery of a distal end portion of an injection tubular portion.

As shown in FIG. 7, in a trigger-type liquid ejector (discharge device) 80 of the present embodiment, an inner diameter of a distal end tubular portion 41 of an injection tubular portion 3 is formed to be larger than that in the first embodiment. Also, a top wall portion 61 of a nozzle tip 81 is disposed in front of the distal end tubular portion 41. An inner tube portion 66 protrudes rearward from the top wall portion 61 and is disposed to surround a circumferential wall portion 60 from the outside in a radial direction in a state in which a gap is formed between the inner tube portion 66 and the circumferential wall portion 60. Further, a length of an outer tube portion 67 in a forward and rearward direction L1 is formed to be shorter than that in the first embodiment. Thus, the outer tube portion 67 partly surrounds the distal end tubular portion 41 from the outside in the radial direction.

Even with the trigger-type liquid ejector 80 configured as above, the same operation and effects as in the first embodiment can be successfully achieved. Particularly, since the inner diameter of the distal end tubular portion 41 is formed to be larger than that in the first embodiment, for example, an outer diameter of a shaft portion 50 of a support body 4 and an inner diameter of the circumferential wall portion 60 of the nozzle tip 81 can be formed to be larger than those in the first embodiment. Therefore, it is possible to easily form the first groove portion 52 and the second groove portion 62, and it is possible to increase an area of portions in which respective spin grooves 63 and 64 are formed. Therefore, the liquid is easily spun more effectively as compared with the first embodiment.

Third Embodiment

Next, a third embodiment of a discharge device according to the present invention will be described. In the third embodiment, components the same as those in the second embodiment will be denoted by the same reference signs, and a description thereof will be omitted here.

Figure 8:
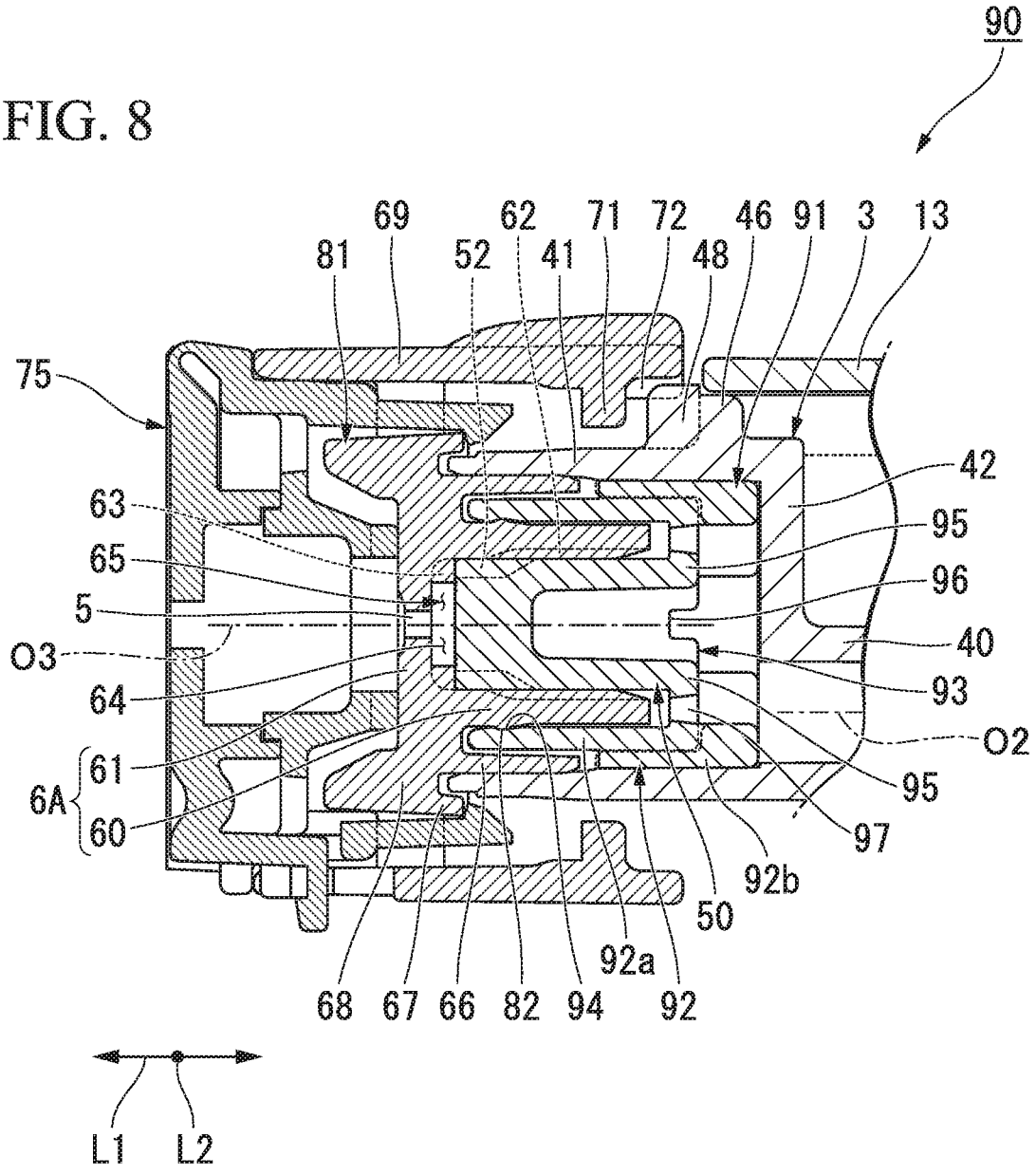
FIG. 8 is a view showing a third embodiment of the trigger-type liquid ejector which is a discharge device according to the present invention and is an enlarged longitudinal sectional view of a periphery of a distal end portion of an injection tubular portion.
Figure 9:
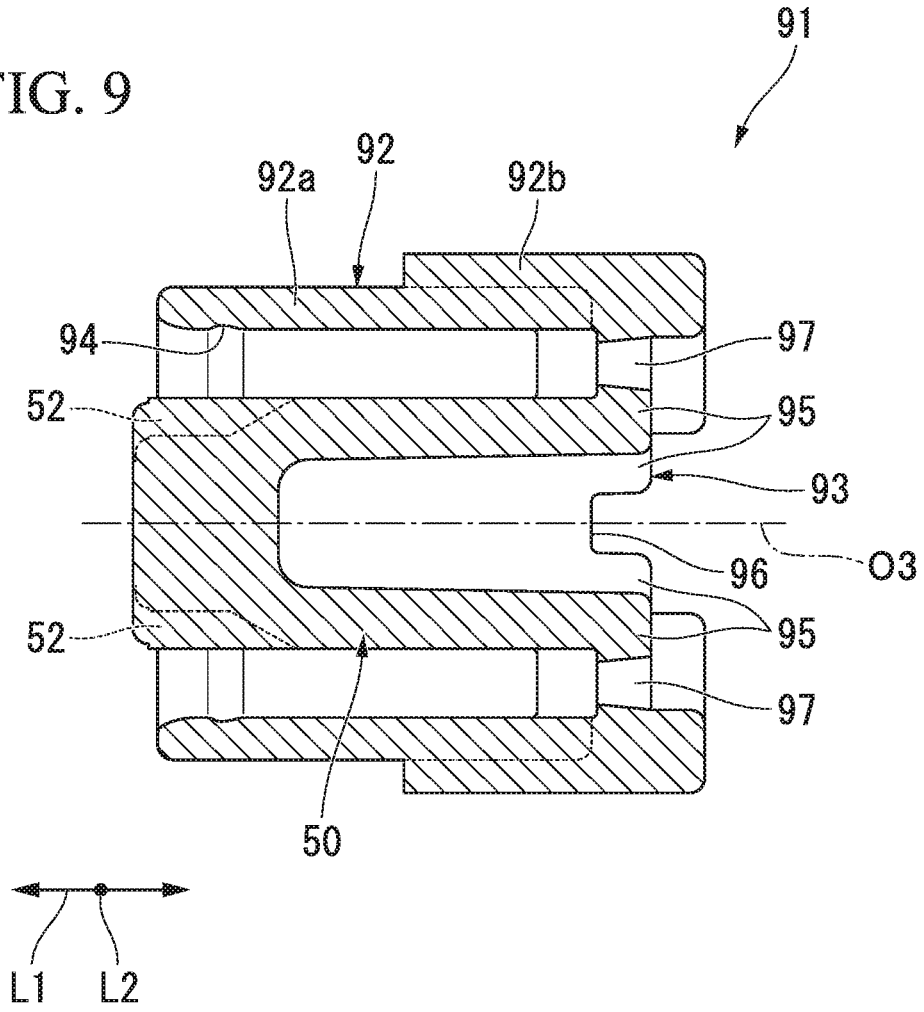
FIG. 9 is a longitudinal sectional view of the support body shown in FIG. 8.
Figure 10:
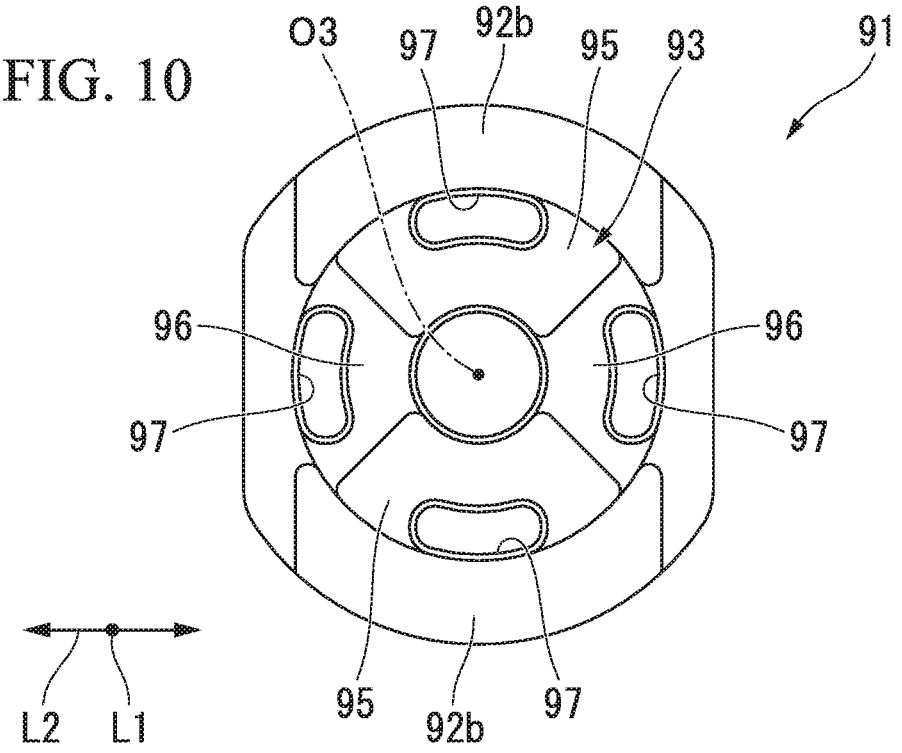
FIG. 10 is a rear view of the support body shown in FIG. 9 when viewed from the rear.
Figure 11:
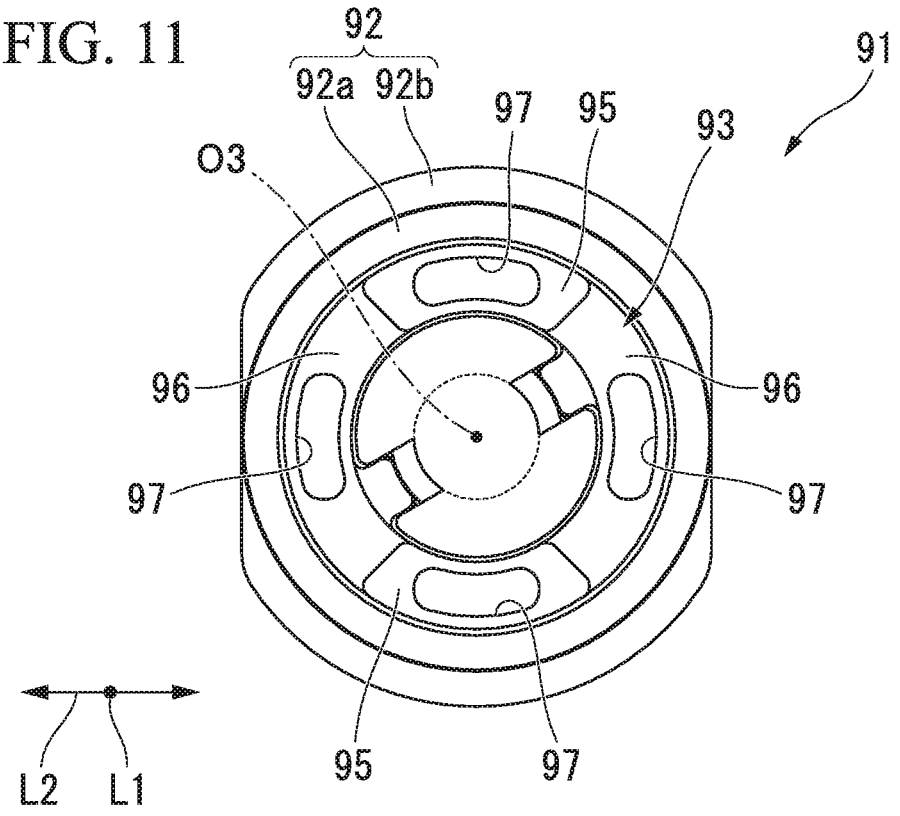
FIG. 11 is a front view of the support body shown in FIG. 9 when viewed from the front.

As shown in FIG. 8, in a trigger-type liquid ejector (discharge device) 90 of the present embodiment, a nozzle tip 81 and a support body 91 are further combined using undercut-fitting. On an outer circumferential surface of a circumferential wall portion 60 of the nozzle tip 81, an engaging protrusion (engaging portion) 82 protruding toward the outside in a radial direction is annularly formed in a circumferential direction.

As shown in FIGS. 8 to 11, the support body 91 includes a shaft portion 50 having a cylindrical shape with a top, a surrounding tube 92 which surrounds the shaft portion 50 from the outside in the radial direction, and an annular connecting portion 93 which connects a rear end portion of the shaft portion 50 and a rear end portion of the surrounding tube 92 in the radial direction.

The surrounding tube 92 is formed such that a front portion 92*a* positioned in front of a substantially central portion in a forward and rearward direction L1 has a smaller outer diameter than a rear portion 92*b* positioned on a rear side of the substantially central portion in the forward and rearward direction L1. Then, the front portion 92*a* of the surrounding tube 92 is disposed between the circumferential wall portion 60 and an inner tube portion 66 of the nozzle tip 81.

The rear portion 92*b* of the surrounding tube 92 slightly protrudes rearward with respect to the connecting portion 93. The rear portion 92*b* of the surrounding tube 92 is formed to have an outer shape corresponding to a shape of an opening 44 inside a distal end tubular portion 41, that is, formed such that a vertical length is longer than a length in the lateral direction L2. In other words, the rear portion 92*b* of the surrounding tube 92 is formed such that portions of an outer peripheral surface positioned on the left and right sides are formed to be flat in a plan view when viewed from the axis O3 direction, and portions positioned above and below are formed into a curved surface in the circumferential direction. Thus, the rear portion 92*b* of the surrounding tube 92 is fitted inside the opening 44 in a state of being in contact with a connecting wall portion 42 from the front. Therefore, the support body 91 is positioned inside the distal end tubular portion 41 in the forward and rearward direction L1 and is fitted in a state in which it is prevented from rotating.

A circumferential groove (engaged portion) 94 which engages an engaging protrusion 82 formed on the nozzle tip 81 by undercut-fitting is formed on an inner circumferential surface of the surrounding tube 92. Thereby, in addition to the fitting of the circumferential wall portion 60 of the nozzle tip 81 and the outer circumferential surface of the shaft portion 50, the support body 91 and the nozzle tip 81 are combined together in a state in which the engaging protrusion 82 is undercut-fitted in the circumferential groove 94. Further, since the engaging protrusion 82 is undercut-fitted in the circumferential groove 94, also in a case of the present embodiment, the nozzle tip 81 can be relatively rotated around the axis O3 with respect to an injection tubular portion 3 and the support body 91.

In the connecting portion 93, a first wall portion 95 and a second wall portion 96 disposed slightly in front of the first wall portion 95 are alternately installed to be continuous in the circumferential direction. Thus, irregular steps are formed on a front surface and a rear surface of the connecting portion 93. In the shown example, the connecting portion 93 includes a pair of first wall portions 95 disposed vertically with the axis O3 interposed therebetween and a pair of second wall portions 96 disposed laterally with the axis O3 interposed therebetween. The first wall portion 95 and the second wall portion 96 are each formed in a fan shape in a plan view when viewed from an axis O3 direction. Further, the first wall portion 95 and the second wall portion 96 have the same thickness in the forward and rearward direction L1.

Thus, on the front surface and rear surface of the connecting portion 93, four steps are formed such that irregularities are alternately repeated in the circumferential direction by the pair of first wall portions 95 and the pair of second wall portions 96. However, the first wall portion 95 and the second wall portion 96 are not indispensable. For example, instead of forming the first wall portion 95 and the second wall portion 96, a front surface and rear surface of the connecting portion 93 may be a flat surface.

Also, in the first wall portion 95 and the second wall portion 96, communication holes 97 that penetrate the first wall portion 95 and the second wall portion 96 in the forward and rearward direction L1 are respectively formed. That is, in the connecting portion 93, four communication holes 97 are formed at regular intervals in the circumferential direction. Each of the communication holes 97 is formed in a long hole shape extending in the circumferential direction. Thereby, it is possible to allow an inside of the base end tubular portion 40 of the injection tubular portion 3 and an inside of an ejection path 65 to communicate through each communication hole 97, and it is possible to reliably introduce the liquid into the ejection hole 5 via the ejection path 65.

Even with the trigger-type liquid ejector 90 configured as above, the same operation and effects as in the first embodiment and the second embodiment can be successfully achieved. Particularly, as shown in FIG. 8, since the engaging protrusion 82 can be undercut-fitted in the circumferential groove 94 in addition to the fitting of the circumferential wall portion 60 of the nozzle tip 81 and the outer circumferential surface of the shaft portion 50, the support body 91 and the nozzle tip 81 can be more strongly and integrally combined. Therefore, even when an internal pressure of the injection tubular portion 3 unexpectedly increases, the nozzle tip 81 and the support body 91 can be easily and integrally displaced more reliably with respect to the injection tubular portion 3.

The technical scope of the present invention is not limited to the above embodiment, and various modifications can be made without departing from the gist of the present invention.

For example, in each of the above embodiments, a trigger-type liquid ejector has been described as an example of the discharge device, but the present invention is not limited thereto. For example, it may be applied to a pump-type discharge device having a push-down head or applied to a discharge device mounted on an aerosol container.

Also, in each of the above-described embodiments, the ejection path 65 having the first spin groove 63 and the second spin groove 64 has been described, but the ejection path 65 may have only the first groove portion 52 and the second groove portion 62 formed therein. In addition, the spin grooves 63 and 64 may be formed not on the nozzle tip 6 but on a front end face of the shaft portion 50 of the support body 4. However, a sufficient area for forming the respective spin grooves 63 and 64 can be secured on the nozzle tip 6 side than on the front end surface of the shaft portion 50 of the support body 4. Accordingly, since the respective spin grooves 63 and 64 are easily formed, it is preferable to form the respective spin grooves 63 and 64 in the nozzle tip 6.

In the third embodiment, the engaging protrusion 82 is formed on the outer circumferential surface of the circumferential wall portion 60 of the nozzle tip 81, but the engaging protrusion 82 may be formed to protrude toward the inside in the radial direction on an inner circumferential surface of the inner tube portion 66, for example. In this case, the circumferential groove 94 may be formed on the outer circumferential surface of the surrounding tube 92 of the support body 91. Even in this case, the support body 91 and the nozzle tip 81 can be combined with each other in a state in which the engaging protrusion 82 is undercut-fitted in the circumferential groove 94.

In the third embodiment, the circumferential groove 94 has been described as an example of the engaged portion that is engaged with the engaging protrusion 82, but it is not limited to a groove. For example, a protrusion protruding toward the inside in the radial direction from the inner circumferential surface of the surrounding tube 92 may be used as the engaged portion. In this case, the engaging protrusion 82 of the nozzle tip 81 may be engaged with the protrusion from a rear side. Thereby, it is possible to maintain the nozzle tip 81 in a state in which it is rotatable around the axis O3 with respect to the support body 91 while preventing the nozzle tip 81 from coming out forward and being detached from the support body 91. Further, as the protrusion in this case, a plurality of protrusions may be formed at intervals in the circumferential direction or an annular protrusion extending in the circumferential direction may be formed.

In addition, the components in the above-described embodiments can be appropriately replaced with well-known components without departing from the spirit and scope of the present invention, and the above-described modified examples may be appropriately combined.

INDUSTRIAL APPLICABILITY

According to the discharge device of the present invention, it is possible to stably discharge the contents in a constant discharge mode without being affected by a change in internal pressure of the flow tube.

REFERENCE SIGNS LIST

A Container
1, 80, 90 Trigger-type liquid ejector (discharge device)
2 Ejector main body (discharge device main body)
3 Injection tubular portion (flow tube)
4, 91 Support body
5 Ejection hole (discharge hole)
6, 81 Nozzle tip
6A Nozzle tip body
50 Shaft portion
51 Flange portion
53 Communication hole
54 Communication groove
60 Circumferential wall portion
61 Top wall portion
63 First spin groove (spin groove)
64 Second spin groove (spin groove)
65 Ejection path (discharge path)
82 Engaging protrusion (engaging portion)
92 Surrounding tube
93 Connecting portion
94 Circumferential groove (engaged portion)

The invention claimed is:

1. A discharge device comprising:

a discharge device main body including a flow tube, an inside thereof through which contents from a container flow, and the discharge device main body being mounted on the container;

a support body extending along the flow tube and fitted to the inside of the flow tube; and a nozzle tip including a nozzle tip body formed in a cylindrical shape with a top including a circumferential wall portion fitted to an outer circumferential surface of the support body and a top wall portion in which a discharge hole for the contents is formed, the nozzle tip being mounted on a distal end portion of the flow tube in a state of being combined with the support body, wherein a discharge path to communicate the inside of the flow tube and the discharge hole with each other is formed between an inner surface of the nozzle tip body and an outer surface of the support body, the support body is formed separately from the flow tube and the nozzle tip, the support body includes a shaft portion disposed inside the circumferential wall portion of the nozzle tip body and into which the circumferential wall portion is fitted from outside in a radial direction, the shaft portion is formed in a cylindrical shape with a top in which a front end of the shaft portion is closed, and an inside of the shaft portion communicates with the inside of the flow tube.

2. The discharge device according to claim 1, wherein the support body further includes an annular flange portion protruding toward the outside in the radial direction from a rear end portion of the shaft portion and fitted to the inside of the flow tube, the discharge path is formed between an inner surface of the nozzle tip body and an outer surface of the shaft portion, a plurality of communication holes penetrating the flange portion and to communicate the inside of the flow tube and an inside of the discharge path with each other are formed in the flange portion at intervals in a circumferential direction, and a communication groove connecting the plurality of communication holes with each other is formed in a rear end surface of the shaft portion.

3. The discharge device according to claim 1, wherein the support body further includes:

a surrounding tube surrounding the shaft portion from the outside in the radial direction, disposed between the circumferential wall portion of the nozzle tip body and the flow tube, and fitted inside the flow tube; and an annular connecting portion connecting a rear end portion of the shaft portion and a rear end portion of the surrounding tube in the radial direction, the discharge path is formed between an inner surface of the nozzle tip body and an outer surface of the shaft portion, a communication hole penetrating the connecting portion and to communicate the inside of the flow tube and an inside of the discharge path with each other is formed in the connecting portion, and an engaged portion which engages an engaging portion formed in the nozzle tip is formed in the surrounding tube.

4. The discharge device according to claim 1, wherein at least a portion of the discharge path is formed by a spin groove which causes the contents to flow in the circumferential direction of the flow tube.

5. The discharge device according to claim 1, wherein the nozzle tip and the support body are configured to be integrally displaced with respect to the flow tube.

* * * * *